US010092943B2

(12) United States Patent
Kochie et al.

(10) Patent No.: US 10,092,943 B2
(45) Date of Patent: Oct. 9, 2018

(54) FLAIRING PLIAR JAWS

(71) Applicants: Bosch Automotive Service Solutions Inc., Warren, MI (US); Robert Bosch GmbH, Stuttgart (DE)

(72) Inventors: Robert J. Kochie, Dodge Center, MN (US); Robert A. Jensen, Clarks Grove, MN (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 225 days.

(21) Appl. No.: 14/941,857

(22) Filed: Nov. 16, 2015

(65) Prior Publication Data

US 2017/0136520 A1 May 18, 2017

(51) Int. Cl.
*B21D 41/02* (2006.01)

(52) U.S. Cl.
CPC ..... *B21D 41/021* (2013.01)

(58) Field of Classification Search
CPC ..... B21D 9/08; B21D 9/085; B21D 41/021; B21D 37/04; B21D 37/10; B21D 37/12; B25B 5/16; B25B 5/163; B25B 5/166; B25B 7/02; B25B 7/04; B25B 13/107; H01R 43/0427; H01R 43/22
USPC ..... 72/409.16, 413; 81/185.1, 421–423
See application file for complete search history.

(56) References Cited

U.S. PATENT DOCUMENTS

| | | | | | |
|---|---|---|---|---|---|
| 2,869,407 | A * | 1/1959 | Swanson | H01R 43/0427 | 72/409.01 |
| 3,949,589 | A * | 4/1976 | Johnson | B21D 28/34 | 72/413 |
| 3,971,275 | A * | 7/1976 | Mach | B21D 28/28 | 83/140 |
| 4,632,374 | A * | 12/1986 | Yang | B25B 1/20 | 269/258 |
| 6,272,738 | B1 * | 8/2001 | Holliday | B25B 7/02 | 72/409.14 |
| 2013/0125603 | A1 * | 5/2013 | Liu | B21D 37/16 | 72/342.3 |
| 2014/0208898 | A1 | 7/2014 | Lesche | | |

OTHER PUBLICATIONS

ATD Tools Inc., ATD-5480 Instructions for in Line Flairing, Rev. B, available online at http://atdtools.com/5480 (3 pages).

* cited by examiner

*Primary Examiner* — Teresa M Ekiert
(74) *Attorney, Agent, or Firm* — Maginot Moore & Beck LLP

(57) ABSTRACT

A system for flaring an end of a fluid line includes a first and second adapter mountable on a first and second jaw of the gripping tool, respectively, and an arbor. Once mounted, the first and second adapters each have a working surface facing toward each other defining a channel half-profile. In a closed position, the working surfaces together form a channel from the half-profiles having a flare shape portion and a linear portion for receiving a fluid line in a non-slip fit. The working surface of one adapter has a U-shaped profile, and the other adapter is configured to be received therein. Each sidewall of the U-shaped profile defines a port opening into the channel. The arbor includes a die head that forms a flared end on a fluid line received in the channel as the arbor is inserted therein via the port.

17 Claims, 5 Drawing Sheets

FLAIRING PLIAR JAWS

TECHNICAL FIELD

This disclosure relates generally to tools for forming fluid delivery lines, and more particularly to hand-operated line flaring tools.

BACKGROUND

Fluid lines are used to deliver a wide variety of working fluids, including fuel, brake fluid, hydraulic fluid, coolant, or the like in a wide variety of applications from automotive or aerospace uses to heavy machinery and more. In some applications, fluid lines are formed from metal tubing, such as a soft steel, copper, or aluminum. Connecting such metal tubing to a device can be accomplished by a variety of methods including welding and soldering. However, in some applications, such as where the use of an open flame is either undesirable or impractical, or such as when the resulting connection is desirably removable, connecting a fuel line to a device can be accomplished by using a fitting.

One well-known type of fitting customarily used for brake lines and fuel lines, for example, is a flared fitting 10, illustrated in FIG. 1. The flared fitting 10 includes a fitting body 12, and a fitting nut 14. The fitting body 12 defines a tapered end 16, a first threaded portion 18, and a second threaded portion 20. The fitting nut 14 defines an internal thread (not shown) configured to be threaded onto the first threaded portion 18 of the fitting body 12, and an axial bore (not shown) that allows that fitting nut 14 to be placed on a fluid line 22. The fluid line 22 includes a flared end 24 that increases a diameter of the fluid line 22 at an angle corresponding to an angle of the tapered end 16 of the fitting body 12.

To assemble the fitting 10, the second threaded portion 20 of the fitting body 12 is threaded into a device (not shown) that is to receive the fluid line 22. The fitting nut 14 is placed on the fluid line 22, generally before the flared end 24 is formed. A flaring operation is performed in order to form the flared end 24. The tapered end 16 of the fitting body 12 is then inserted into the flared end 24, and the fitting nut 14 is then threaded onto the first threaded portion 18 of the fitting body 12 in order to compress the flared end 24 of the fluid line 22 against the tapered end 16 of the fitting body 12. The resulting fitting 10 is robust against leaks, pressure-resistant, and is also resistant to strain and vibrational loads.

Various applications use tapers of different angles as appropriate. For example, brake lines, coolant lines, and fuel lines typically use a 45 degree taper, while hydraulic lines generally use a 37.5 degree taper. Various types of flared ends can also be formed. FIG. 2A illustrates a fluid line 22 with a single flared end 26, and FIG. 2B illustrates a fluid line 22 with a double flared end 28. In some applications, a single flared end 26 is sufficient, but a double flared end 28 can help prevent the fluid line from cracking when the fitting nut 14 is tightened down and can improve the strength and resilience of the connection.

The flaring operation, a forging operation that includes cold-working the fluid line 22, is performed via a flaring tool. Flaring tools customarily needed to be mounted on a rigid support like a vice clamp. This meant that a significant amount of workspace was needed to operate the tool, and that fluid lines could not generally be worked in situ, i.e., while the other end is attached to a vehicle brake or fluid system.

Flaring tools have been developed that operate in-line, i.e., without requiring disassembly of a fluid system in order to gain access to a fluid line and operate the flaring tool. In one example, hydraulic flaring tools have been developed that use hydraulic pressure and a piston to drive a die head into a fluid line mounted in a die adapter. Such devices can be operated by a user without being mounted on a support, but are expensive, costly, and complex to use.

Manual in-line flaring tools have also been developed. The ATD-5480 In-Line Flaring Tool available from ATD Tools, Inc., illustrated in FIG. 3, includes a bar clamp 30, a hex yoke 32, a center screw 34, and a flare adapter 36. The bar clamp includes cap screws 38 for clamping the bar clamp 30 together, and defines an external thread 40 with an axial bore. The hex yoke 32 has an axial bore 42 with an internal thread and a hex-shaped exterior 44. The flare adapter 36 is configured to be inserted into an end of a fluid line, and is operable to form a flared end thereof. The center screw 34 has an external thread configured to engage the inner thread of the hex yoke 32, and a hex-shaped head 46.

A fluid line is inserted into the axial bore of the bar clamp 30 with an end protruding from the external thread 40, and the cap screws 38 are tightened to clamp the fluid line therein. The flare adapter 36 is inserted into the end of the fluid line, and the hex yoke 32 is mounted over the external thread 40 of the bar clamp 30. The center screw 34 is then inserted into the internal thread of the hex yoke 32, and is threaded down to engage the flare adapter 36 and form a bubble on the fluid line. To thread the center screw 34 down, a user can grip the hex yoke 32 in one hand via a first wrench or grip, and can use a second wrench or grip on the head 46 of the center screw 34. The center screw 34 and hex yoke 32 can then be removed in order to remove the flare adapter 36. The hex yoke 32 and center screw 34 can then be replaced and threaded down in order to form the bubble into a double flared end.

While the ATD In-Line Flaring Tool allows a user to produce a flared end on a fluid line without disassembling a fluid system, the In-Line Flaring Tool may not be adapted for use in the close quarters or cramped environments generally found in the vicinity of fluid line connections. For example, the necessity of threading and unthreading the hex yoke from the bar clamp for each operation adds difficulty and complexity, especially in a process where a user may have an obstructed view of the operation. Additionally, the tool requires several independent parts that are sized to tight tolerances, and thus a kit accommodating a variety of sizes of fluid lines will be large and expensive.

Therefore, what is needed is a manual in-line flaring tool that is adapted for use in a cramped environment, that can be operated by a user with an obstructed view, and that is simple and easy to use.

SUMMARY

In order to facilitate performing flaring operations on the ends of fluid lines, a system for flaring an end of a fluid line includes a gripping tool, a first jaw adapter, a second jaw adapter, and an arbor. The first jaw adapter includes a bottom surface mountable on a first jaw of the gripping tool, a working surface opposite the bottom surface that defines a U-shaped cavity, and a pair of opposite end surfaces that each defines a port opening into interior walls of the U-shaped cavity. The working surface further defines a channel half profile having a flare shape portion extending from a port of one of the end surfaces and a linear portion extending from the flare shape portion toward the opposite end surface. The second jaw adapter includes a top surface that defines a slot mountable on a second jaw of the gripping tool, and a working surface opposite the top surface that defines a further channel half profile mirroring the channel half profile of the first jaw adapter. The second jaw adapter is configured to be received in the U-shaped cavity of the first jaw adapter such that the working surface of the second jaw adapter engages with the working surface of the first jaw adapter to form a channel from the channel half profile and the further channel half profile. The channel has a flare shape part and a linear port. The linear part is configured to receive a fluid line of a first diameter with a tight non-slip fit. The arbor includes a die head that, as the arbor is inserted into the channel via a port, interacts with the flare shape part of the channel to form a flared end on a fluid line received in the channel.

In an embodiment, each of the bottom surface of the first jaw adapter and the top surface of the second jaw adapter defines a slot that is mountable on the first and second jaw of the gripping tool, respectively. In a further embodiment, the slots each include an end wall that acts as a stop surface for aligning the jaw adapters of the corresponding jaws of the gripping tool.

In one embodiment, each of the first jaw adapter and second jaw adapter includes a magnet for at least one of aligning the jaw adapter with the respective jaw of the gripping tool, aligning the jaw adapter with the other jaw adapter, and retaining the jaw adapter on the respective jaw of the gripping tool. In an embodiment, each of the bottom surface of the first jaw adapter and the top surface of the second jaw adapter further defines a cavity for receiving a magnet. In another embodiment, the cavity is defined in the slot.

In an embodiment, the gripping tool is a pair of locking pliers configured to be lockable in a closed position.

In one embodiment, the arbor is reversible, and includes a further die head opposite the die head for forming a different type of flared end than the die head.

In another embodiment, the bottom surface and working surface of the first jaw adapter are at a first angle from each other, such as about 10 degrees. In an embodiment, the top surface and working surface of the second jaw adapter are at a second angle from each other, such as about 35 degrees. In a further embodiment, the first angle and second angle are configured such that, in a closed position of the gripping tool, the working surfaces of the first and second jaw adapters are substantially parallel.

In another embodiment, the port defines an internal thread, and the arbor includes an externally threaded portion that can be threaded into the internal thread of the port.

In a further embodiment, the first and second jaw adapter along with the arbor form an adapter set configured to operate on a fluid line having the first diameter. In another embodiment, the system further includes at least one additional set of an additional first adapter, an additional second adapter, and an additional arbor configured to operate on a fluid line having a diameter different than the first diameter.

This summary is intended only to introduce subject matter pertaining to a bushing service tool which is discussed in more detail in the detailed description, the drawings, and the claims, and is not intended to limit the scope of this disclosure in any way.

BRIEF DESCRIPTION OF THE DRAWINGS

The foregoing aspects and other features of the present disclosure are explained in the following description, taken in connection with the accompanying drawings.

DETAILED DESCRIPTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Figure 1:
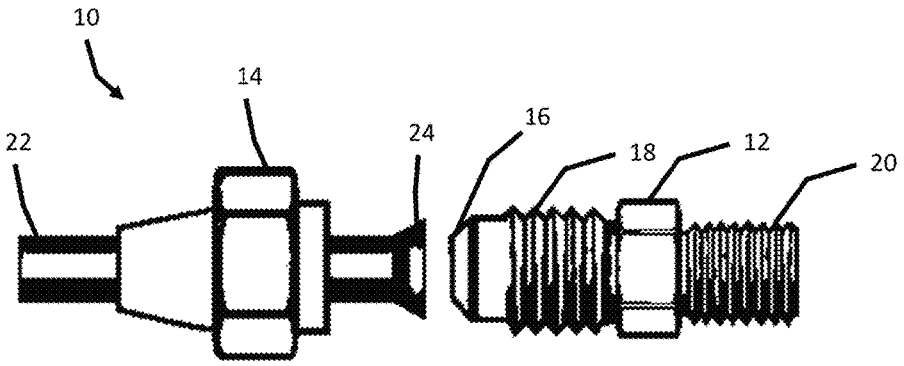
Fig. 1 PRIOR ART
FIG. 1 illustrates a known configuration of a flared fitting for a fluid line.
Figure 2A:
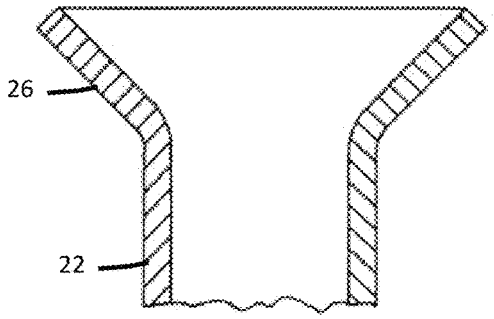
FIGS. 2A and 2B illustrate different known configurations for flared ends of fluid lines.
Figure 2B:
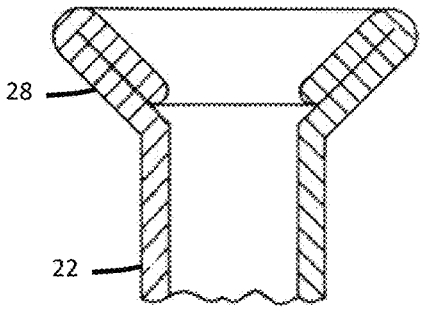
Fig. 2B PRIOR ART
Figure 3:
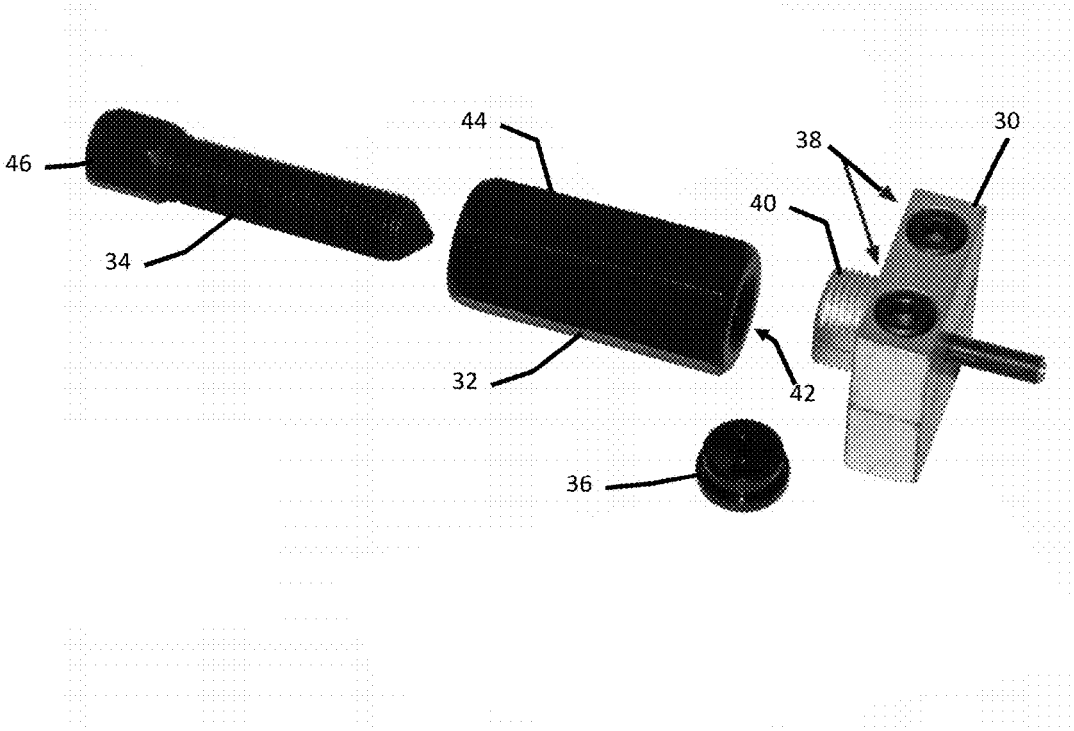
Fig. 3 PRIOR ART
FIG. 3 is a perspective view of a known in-line tool for flaring an end of a fluid line.
Figure 4:
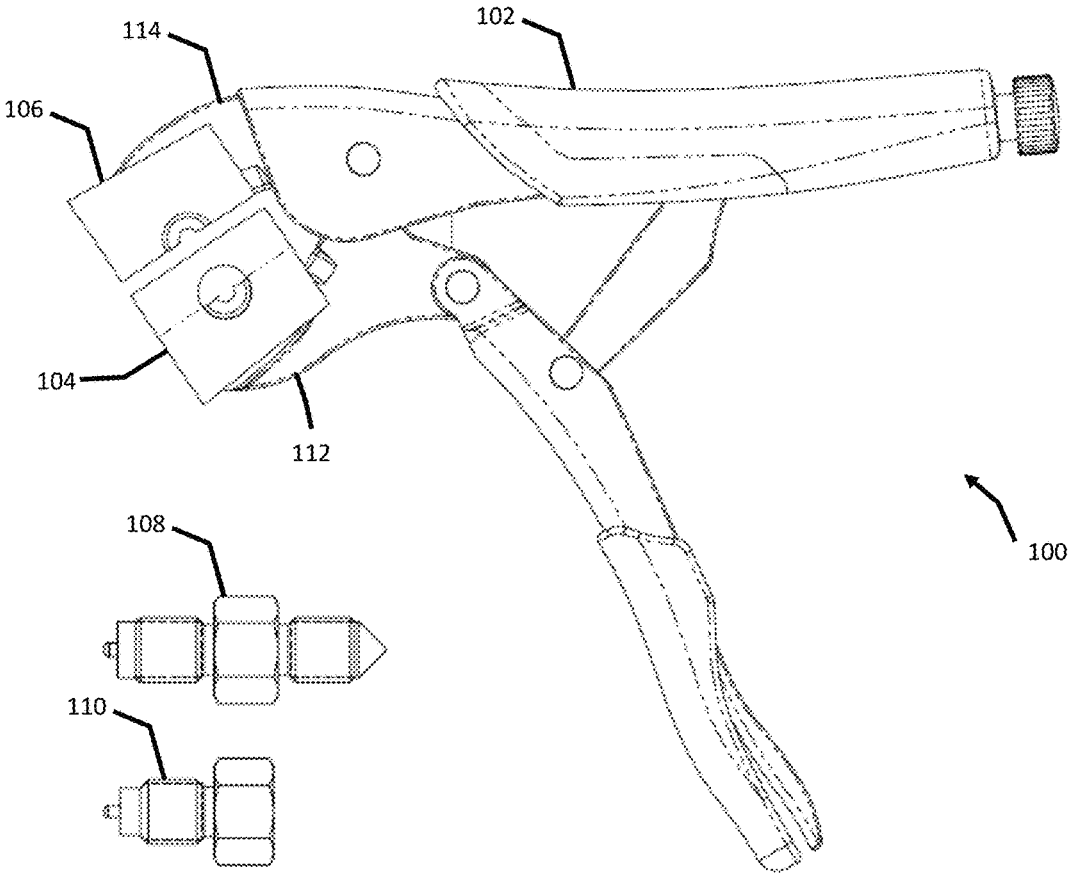
FIG. 4 illustrates an exemplary embodiment of a system for flaring an end of a fluid line according to this disclosure.

FIG. 4 depicts an exemplary embodiment of a system 100 for flaring fluid lines according to this disclosure. The system 100 includes a pair of pliers 102, a first jaw adapter 104, a second jaw adapter 106, and arbors 108 and 110.

The pliers 102 includes a first jaw 112 and a second jaw 114, and can be any type of acceptable type of pliers, vice grip, or other type of gripping tool. In this embodiment, the pliers 102 are a pair of locking pliers that can be adjusted to open the jaws 112 and 114 to a certain distance, and that can be locked onto an object gripped between the jaws 112 and 114. The jaws of pliers, such as the jaws 112 and 114 are generally rough or ridged in order to facilitate gripping an object therebetween. However, the rough or ridged jaws may render gripping certain objects such as tubing difficult or impossible without damaging the object during operation.

Jaw adapters have been developed that allow a pair of pliers to grip objects like tubing without damage, such as the jaw adapters described in U.S. patent application Ser. No. 14/158,362 (the '362 application) filed on Jan. 17, 2014 and entitled "Locking Plier Jaws," the disclosure of which is incorporated by reference herein in its entirety. When a reference includes terms that are similar to terms used herein, the meaning of the terms as set forth herein controls with regard to this disclosure, and the meaning of the terms as set forth in the reference does not apply. The jaw adapter configuration "substantially prevents permanent deformation of [a] tubular work-piece" gripped by the pliers. Each jaw adapter component includes half of an internal profile of a channel such that when two jaw adapters are placed on opposite jaws of a pair of pliers facing toward each other, a channel adapted for receiving a tubular workpiece is defined by the two half profiles. A slot in each jaw adapter is configured to fit over the jaw of the pliers in order to align the jaw adapters with the pliers and with each other. The jaws of the pliers disclosed in the '362 application include a metal, and the jaw adapters each include a magnet that is configured to exert a magnetic force toward the metal of the jaws to retain the jaw adapters on the jaws. In order to grip a tubular workpiece, a user mounts the jaw adapters onto the jaws of the pliers and closes the pliers around the tubular workpiece so that the tubular workpiece is received in the channel defined between the jaw adapters. The workpiece can then be held and manipulated without permanent deformation.

However, flaring a fluid line is a cold work forging operation that results in the permanent deformation of the end of the fluid line. The first jaw adapter 104 and second jaw adapter 106 according to this disclosure are configured to enable a flaring operation to be performed on a fluid line inserted therebetween.

Figure 5A:
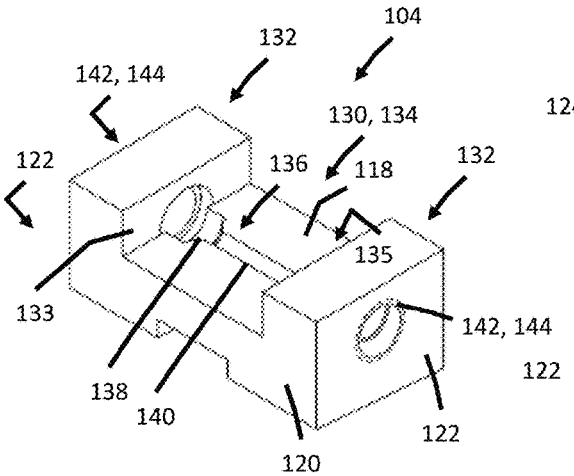
FIGS. 5A and 5B illustrate perspective views of a first jaw adapter of the system of FIG. 4.
Figure 5B:
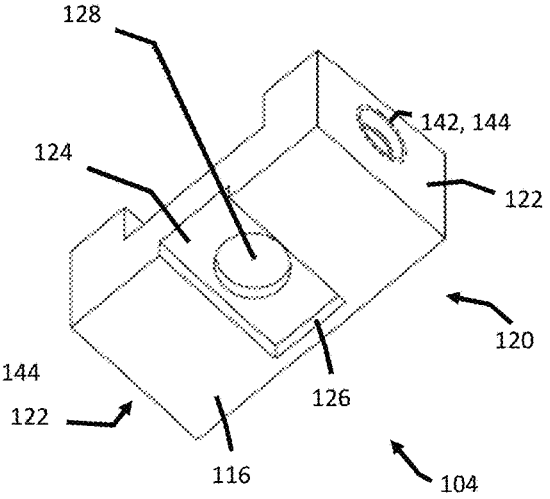

FIG. 5A illustrates a top perspective view, and FIG. 5B illustrates a bottom perspective view of the first jaw adapter 104 of FIG. 4. The first jaw adapter 104 defines a bottom surface 116, a working surface 118, a pair of opposing lateral surfaces 120 and a pair of opposing end surfaces 122.

The bottom surface 116 includes a slot 124 that extends partway from one of the lateral surfaces 120 toward the opposite lateral surface 120 to define an end wall 126. The slot 124 is configured to receive the first jaw 112 of the pliers 102. The end wall 126 acts as a stop surface, and is configured to engage an end of the first jaw 112 in order to delimit how far the first jaw 112 can be received, and to align the first jaw adapter 104 with the first jaw 112. The slot 124 further includes a cavity 128 configured to receive a magnet (not shown).

In one embodiment, the first jaw adapter 104 and the first jaw 112 each include metal, such that the magnet, is retained in the cavity 128 via magnetic force and such that the first jaw adapter 104 is retained on the first jaw 112 by magnetic force. In another embodiment, the magnet is fixedly attached to the first jaw adapter 104 in the cavity 128, such as via a press fit, via a bonding agent, via a weld, screw, or snap connection, or via any other acceptable attachment technique. The magnet can be, for example, a neodymium magnet of a grade of N42. The strength of the magnet is selected such that the first jaw adapter 104 maintains a firm connection to the first jaw 112 once mounted, but also such that the first jaw adapter 104 does not become permanently affixed to the first jaw 112.

In another embodiment, the adapter 104 does not include a cavity, and the magnet is integral with the adapter 104. In one embodiment, the magnet defines the slot 124 and/or the end wall 126.

As illustrated in FIGS. 4, 5A, and 5B, the working surface 118 faces substantially away from the bottom surface 116. In this embodiment, the working surface 118 faces away from the bottom surface 116 at an angle of approximately 10 degrees, but in other embodiments, the bottom surface 116 and working surface 118 can be at other angles.

In this embodiment, the working surface 118 defines a U-shaped cavity 130 such that end portions 132 of the first jaw adapter 104 protrude out from a central portion 134 of the working surface 118 in a direction normal to the working surface 118. In another embodiment, the working surface 118 may define a single end portion 132 such that the central portion 134 extends to the opposite end surface 122.

The working surface 118 further defines a half profile 136 of a channel. The half profile 136 includes a flare shape portion 138 that extends from an inside wall 133 of one end portion 132, and a linear portion 140 that extends from the flare shape portion toward an inside wall 135 of the opposite end portion 132. In this embodiment, the half profile 136 further includes a second flare shape portion (not shown) extending from the opposite end portion 132. Each end portion 132 defines a port 142 that is fully surrounded by the corresponding end surface 122 and that opens into the U-shaped cavity 130 such that a bottom surface of the half profile 136 is contiguous with the port 142. Each port 142 further includes an internal thread 144.

Figure 6A:
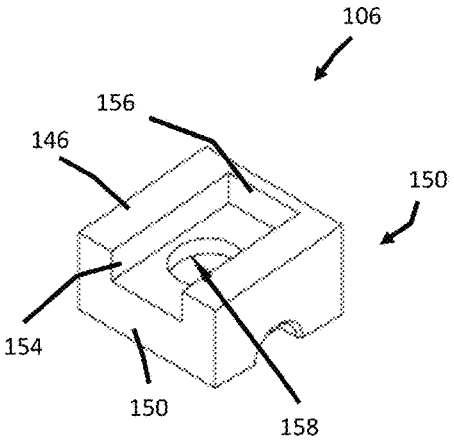
FIGS. 6A and 6B illustrate perspective views of a second jaw adapter of the system in FIG. 4.
Figure 6B:
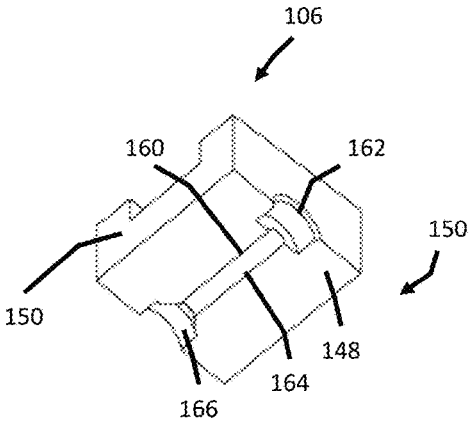

FIG. 6A illustrates a top perspective view and FIG. 6B illustrates a bottom perspective view of the second jaw adapter 106 of FIG. 4. The second jaw adapter includes a top surface 146, a working surface 148, a pair of opposing lateral surfaces 150, and a pair of opposing end surfaces 152.

The top surface 146 includes a slot 154 that extends partway from one of the lateral surfaces 150 toward the opposite lateral surface 150 to define an end wall 156. The slot 154 is configured to receive the second jaw 114 of the pliers 102. The end wall 156 acts as a stop surface, and is configured to engage an end of the second jaw 114 in order to delimit how far the second jaw 114 can be received, and to align the second jaw adapter 106 with the second jaw 114 and with the first jaw adapter 104. The slot 154 further includes a cavity 158 configured to receive a further magnet (not shown).

In one embodiment, the second jaw adapter 106 and the second jaw 114 each include metal, such that the further magnet, is retained in the cavity 158 via magnetic force and such that the second jaw adapter 106 is retained on the second jaw 114 by magnetic force. In another embodiment, the further magnet is fixedly attached to the second jaw adapter 106 in the cavity 158, such as via a press fit, via a bonding agent, via a weld, screw, or snap connection, or via any other acceptably attachment technique. The further magnet can be, for example, a neodymium magnet of a grade of N42. The strength of the further magnet is selected such that the second jaw adapter 106 maintains a firm connection to the second jaw 114 once mounted, but also that the second jaw adapter 106 does not become permanently affixed to the second jaw 114. The further magnet may be placed in the cavity 158 in an opposite orientation to the orientation of the magnet in the cavity 128 of the first jaw adapter 104 such that the magnet and further magnet exert an attractive magnetic force toward each other once mounted in the pliers 102. In another embodiment, the magnet and further magnet are oriented to exert a repulsive magnetic force on each other, and in a further embodiment, the magnet and further magnet are configured to have a negligible magnetic effect on each other.

As illustrated in FIGS. 4, 6A, and 6B, the working surface 148 faces substantially away from the top surface 146. In this embodiment, the working surface 148 faces away from the top surface 146 at an angle of approximately 35 degrees, but in other embodiments, the top surface 146 and working surface 148 can be at other angles.

The angle between the bottom surface 116 and the working surface 118 of the first jaw adapter 104 and the angle between the top surface 146 and the working surface 148 of the second jaw adapter 106 are configured such that, when the first and second jaw adapters 104 and 106 are received on the first and second jaws 112 and 114 of the pliers 102, the working surface 118 of the first jaw adapter 104 is substantially parallel with the working surface 148 of the second jaw adapter 106, as illustrated in FIG. 4.

The working surface 148 of the second jaw adapter 106 defines a further half profile 160 of a channel that includes a flair shape portion 162 that extends from an end surface 152 and a linear portion 164 that extends from the flare shape portion 162 toward the opposite end surface 152. In this embodiment, the working surface 148 further defines a second flare portion 166 extending from the opposite end surface 152.

Figure 7A:
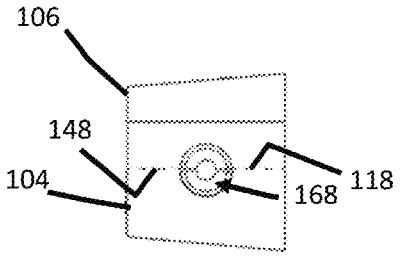
FIG. 7A illustrates an end view.
Figure 7B:
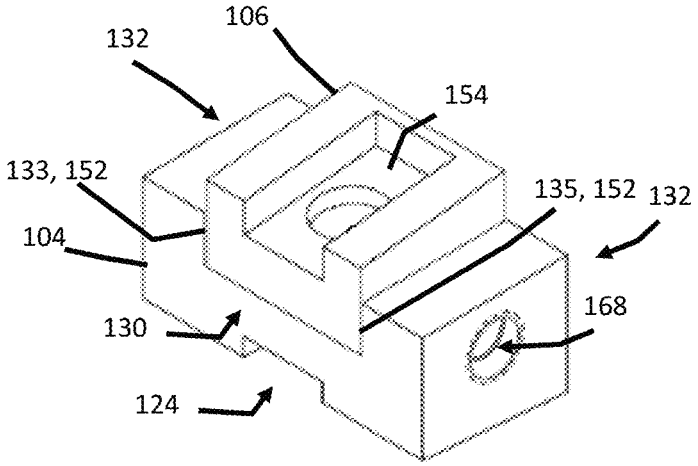
FIG. 7B illustrates a perspective view of the first jaw adapter and second jaw adapter of the system in FIG. 4 in a closed position.

The second jaw adapter 106 is configured to be received with a close running fit in the U-shaped cavity 130 of the first jaw adapter 104, as illustrated in FIGS. 7A and 7B, such that the working surface 148 engages the working surface 118 and the end surfaces 152 of the second jaw adapter 106 engage the inner surfaces 133 and 135 of the end portions 132.

Each of the end surfaces 152 of the second jaw adapter 106 is configured to be parallel to a corresponding one of the inner surfaces 133 and 135 of the end portions 132. In this embodiment, the end surfaces 152 and the inner surfaces 133 and 135 are each perpendicular to the working surfaces 118 and 148 respectively, and are also perpendicular to the lateral surfaces 120 and 150 respectively. In other embodiments, the end surfaces and inner surfaces 133 and 135 can have other orientations. For example, in one embodiment, the inner surfaces 133 and 135 form obtuse angles with the central portion 134 of the first jaw adapter 104. This configuration may allow the inner surfaces 133 and 135 to guide the end portions 152 of the second jaw adapter 106 as the second jaw adapter 106 is inserted into the U-shaped cavity 130.

When the second jaw adapter 106 is received in the U-shaped cavity 130 of the first jaw adapter 104, the half profile 136 in the working surface 118 (FIG. 5A) and the further half profile 160 in the working surface 148 (FIG. 6B) combine to form a channel 168. In other words, the further half profile 160 is configured such that the flare shape portions 162, 166 and linear portion 164 are aligned with the flare shape portions 132, linear portion 140, and ports 142 of the first jaw adapter 104 to form the channel 168. The channel 168 is sized to receive a fluid line with a tight, non-slip fit (in the linear portions 140 and 164), and the flare shape portions are configured to interact with an arbor, such as the arbor 108 or 110 of FIG. 4, for forming a flared end, as discussed in further detail below.

In order to achieve a tight, non-slip fit with a fluid line, the half profiles 136 and 160 are formed within tight tolerances for a particular size fluid line. In an embodiment, the system 100 further includes a plurality of sets of first jaw adapters 104 and second jaw adapters 106, with each set sized for a particular size fluid line. Common sizes of fluid lines include 3/16 inch diameter and 4.75 mm diameter fluid lines, but other diameters are also contemplated.

In this embodiment, as illustrated in FIG. 7B, the slots 124 and 154 are similarly sized, such that either adapter 104, 106 can be installed on either jaw 112, 114 of the pliers 102. This configuration assists a user installing the jaw adapters 104, 106 during an operation where visibility may be obstructed. In another embodiment where the jaws 112 and 114 of the pliers 102 are differently sized, the slots 124 and 154 can have different sizes or shapes such that each adapter 104 and 106 can only be mounted on a corresponding one of the jaws 112 and 114, such as via a form fitting shape for each slot 124 and 154.

The first and second jaw adapters 104 and 106 can be formed from a variety of materials, such as a metal, composite, ceramic, or the like. In one embodiment, at least one of the top surface 146, bottom surface 116, and half profiles 136 and 160 are lined with a material configured to reduce wear, or act as a cushioning member. In one example, a rubber material could be used to increase a grip between the adapters 104, 106 and the jaws 112, 114, or could be used to cushion a fluid line installed in the channel 168 to help prevent deformation of the fluid line during operation.

Figure 8:
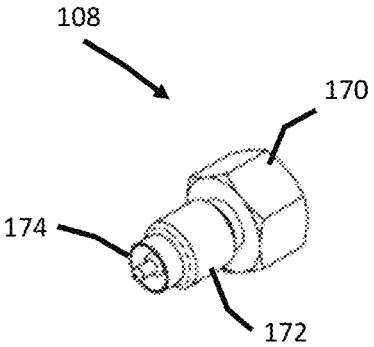
FIGS. 8 and 9 illustrate perspective views of different arbors of the system in FIG. 4.

FIG. 8 illustrates a perspective view of the arbor 108 of FIG. 4. The arbor 108 includes a hex-shaped portion 170, an external thread portion 172, and a die head 174.

The thread portion 172 is configured to be threaded into the internal thread 144 of the ports 142 in the first jaw adapter 104 (FIG. 7B). The hex-shaped portion 170 has a larger diameter than a diameter of the port 142, and thus acts as a stop which delimits an extent to which the arbor 108 can be threaded into the first jaw adapter 104. The hex-shaped portion 170 is also configured to be gripped via a tool such as any acceptable grip or wrench, or more particularly a ratchet, which can be operated to thread the arbor 108 into the first jaw adapter 104. The die head 174 extends axially from the threaded portion 172 opposite the hex-shaped portion 170 such that as the thread portion 172 is threaded into the internal thread 144 of the port 142, the die head 174 moves into the flare shape portion 132 of the first jaw adapter.

The die head 174 of the arbor 108 is configured to form a bubble flare, and is sized to operate with the flare shape portion 132 to form a flared end in a particular size of fluid line. In other embodiments, any acceptable type of die head for forming a flared end can be used, such as an angled die for forming a single or double flared end, and the like. In one embodiment, the system 100 includes a plurality of different arbors 108 for different sizes of fluid line, and for different types of flared ends.

Figure 9:
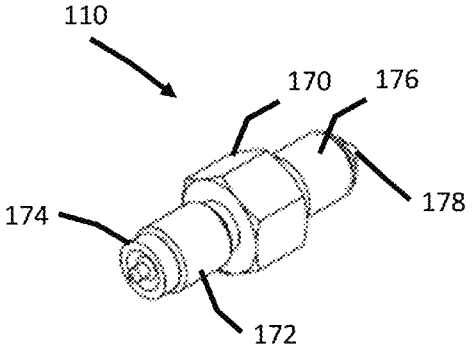

FIG. 9 illustrates a perspective view of the arbor 110 of FIG. 4. The arbor 110 includes a hex-shaped portion 170, a first threaded portion 172, a first die head 174, a second threaded portion 176, and a second die head 178. The first and second threaded portions 172 and 176 extend in opposite directions from the hex-shaped portion 170, and the first and second die heads 174 and 178 extend axially from the first and second threaded portions 172 and 176, respectively. The second die head 178 is a different die head than the first die head 174, and in this embodiment is an angled die configured to operate with the flare shape portion 132 to form a flared end in a fluid line. Since the arbor 109 has two different die heads 174 and 178, the arbor 110 is reversible for performing two different flaring operations, such as forming a bubble flare with the die head 174, and then forming a double flared end with the die head 178. In other embodiments, the reversible arbor 110 can include other couples of die heads.

To perform a flaring operation on a fluid line of a particular size, a corresponding set of jaw adapters 104 and 106 and a corresponding arbor 108 or 109 is selected. The jaw adapters 104 and 106 are mounted on the jaws 112 and 114 of the pliers, as illustrated in FIG. 4. The slots 124 and 154 as well as the magnets enable blind installation of the adapters 104 and 106, and also ensure that the adapters 104 and 106 are aligned with each other and with the pliers 102.

Since the adapters 104 and 106 are removably attached to the pliers 102, a user can easily grip and release the fluid line by positioning the pliers 102 over the fluid line, and closing or releasing the pliers 102 respectively. For example, a user can easily grip onto an easily accessible portion of a fluid line, and only lightly close the pliers 102 so that the half profiles 136 and 160 form a running fit with the fluid line instead of a tight non-slip fit. The user can then slide the pliers 102 along the fluid line until an end of the fluid line is flush with one of the ports 144 in the first jaw adapter 104. Once the end of the fluid line is positioned flush with the port 144, the user can lock the pliers 102 closed, and threads the arbor 108 or 110 into the port 144, for example, with the assistance of a wrench or ratchet. As the arbor 108 or 110 is threaded into the port 144, the die head 174 or 178 acts on the end of the fluid line to form a flared end. The arbor 108 or 110 is then unthreaded and removed.

In one embodiment, an arbor having an angled die head similar to the die head 178 in FIG. 9 is threaded into the port 144 to form a single flared end on the fluid line. In another embodiment, the arbor 110 is threaded into the port 144 with the die head 174 facing inward to the fluid line to form a bubble flare, and then removed. Then, the arbor 110 is threaded into the port 144 with the die head 178 facing inward toward the fluid line to form the bubble flare into a double flared end.

After the flared end has been formed, the pliers 102 can be unlocked and removed from the fluid line. The adapters 104 and 106 can be removed from the jaws 112 and 114 of the pliers, or the pliers can be easily repositioned to another fluid line for performing another operation.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the disclosure.

The invention claimed is:

1. Jaw adapters for a gripping tool for forming a flared end on a fluid line, comprising:

a first jaw adapter that includes:

a bottom surface that defines a slot mountable on a first jaw of the gripping tool;

a working surface opposite the bottom surface that defines a U-shaped cavity; and a pair of opposite end surfaces that each includes a port opening into interior walls of the U-shaped cavity, the working surface further defining a channel half profile having a flare shape portion extending from a port of one of the end surfaces and a linear portion extending from the flare shape portion toward the opposite end surface; and a second jaw adapter that includes:

a top surface that defines a slot mountable on a second jaw of the gripping tool; and a working surface opposite the top surface that defines a further channel half profile mirroring the channel half profile of the first jaw adapter;

the second jaw adapter configured to be received in the U-shaped cavity of the first jaw adapter such that the working surface of the second jaw adapter engages with the working surface of the first jaw adapter to form a channel from the channel half profile and the further channel half profile;

the channel having a flare shape part usable during a flaring operation to form a flared end on a fluid line, and a linear part configured to have a tight no-slip fit with the fluid line when the second jaw adapter is received in the U-shaped cavity of the first jaw adapter; and the bottom surface at an angle from the working surface of the first jaw adapter, and the top surface at an angle from the working surface of the second jaw adapter such that the working surface of the first jaw adapter is substantially parallel to the working surface of the second jaw adapter when the first jaw adapter and second jaw adapter are mounted on the first and second jaws of the gripping tool, respectively.

2. The jaw adapters of claim 1, wherein:

the first jaw adapter and the second jaw adapter each further include a pair of opposite lateral surfaces; and the slot in the bottom surface and the slot in the top surface each extends from one of the lateral surfaces and at least partway toward an other of the lateral surfaces.

3. The jaw adapters of claim 2, wherein the slot in the bottom surface and the slot in the top surface each include an end wall configured to act as a stop surface for aligning the first jaw adapter and second jaw adapter on the first and second jaws of the gripping tool, respectively, and for aligning the first jaw adapter and second jaw adapter with each other.

4. The jaw adapters of claim 1, wherein the port on at least one of the end surfaces includes an internal threading.

5. The jaw adapters of claim 1, wherein the angle between the bottom surface and the working surface of the first jaw adapter is approximately 10 degrees.

6. The jaw adapters of claim 5, wherein the angle between the top surface and the working surface of the second jaw adapter is approximately 35 degrees.

7. The jaw adapters of claim 1, further comprising a pair of magnets, wherein:

the bottom surface and the top surface each include a cavity; and one of the magnets is received in the cavity in the bottom surface, and the other magnet is received in the cavity in the top surface.

8. The jaw adapters of claim 7, wherein:

the cavity in the bottom surface is located within the slot in the bottom surface; and the cavity in the top surface is located within the slot in the top surface.

9. The jaw adapters of claim 1, wherein:

the first jaw adapter is one of a plurality of first jaw adapters;

the second jaw adapter is one of a plurality of second jaw adapters, each second jaw adapter being in a set with a corresponding first jaw adapter; and each set defining a channel sized to correspond to a fluid line of a different diameter.

10. A system for flaring an end of a fluid line, comprising:

a gripping tool for forming a flared end on a fluid line, the gripping tool including a first jaw and a second jaw configured to grip a workpiece therebetween;

a first jaw adapter that includes:

a bottom surface that defines a slot mountable on the first jaw;

a working surface opposite the bottom surface that defines a U-shaped cavity; and a pair of opposite end surfaces that each includes a port opening into interior walls of the U-shaped cavity;

wherein the working surface of the first jaw adapter further defines a channel half profile having a flare shape portion extending from a port of one of the end surfaces and a linear portion extending from the flare shape portion toward the opposite end surface a second jaw adapter that includes:

a top surface that defines a slot mountable on the second jaw; and a working surface opposite the top surface and facing toward the working surface of the first jaw adapter when the first jaw adapter and second jaw adapter are mounted on the first jaw and second jaw, respectively, wherein the working surface of the second jaw adapter defines a further channel half profile mirroring the channel half profile of the first jaw adapter such that, in a closed position of the gripping tool, the channel half profile and the further channel half profile together form a channel having a flare shape portion and a linear portion that is configured to receive a fluid line with a tight non-slip fit, wherein the working surface of the first jaw adapter has a U-shaped profile, and the second jaw adapter is configured to be received in the U-shaped profile in the closed position of the gripping tool such that the working surface of the first jaw adapter and the working surface of the second jaw adapter engage each other to form a channel from the channel half profile and the further channel half profile, wherein each side wall of the U-shaped profile of the working surface of the first jaw adapter defines a port that opens into the channel, and wherein the bottom surface of the first jaw adapter is at an angle from the working surface of the first jaw adapter and the top surface of the second jaw adapter is at an angle from the working surface of the second jaw adapter such that, in the closed position, the working surface of the first jaw adapter is substantially parallel with the working surface of the second jaw adapter; and an arbor that includes a die head configured to be received within a fluid line received in the channel as the arbor is inserted into the port to thereby form a flared end in the fluid line.

11. The system of claim 10, wherein:

the port defines an internal thread; and the arbor includes an externally threaded portion extending axially from the die head such that the die head is inserted into the channel via the port as the externally threaded portion is threaded into the internal thread of the port.

12. The system of claim 10, wherein the gripping tool is a pair of locking pliers configured to lock the first and second jaw adapters in the closed position.

13. The system of claim 10, further comprising:

a first magnet mounted in the first jaw adapter; and a second magnet mounted in the second jaw adapter, wherein the first jaw and the second jaw each include a metal such that the first magnet and second magnet produce a magnetic force to removably restrain and align the first jaw adapter and second jaw adapter on the first jaw and second jaw, respectively.

14. The system of claim 10, further comprising:

at least one additional first jaw adapter;

at least one additional second jaw adapter; and at least one additional arbor;

wherein the first jaw adapter, second jaw adapter, and arbor together form an adapter set configured to operate on a fluid line having a first diameter; and wherein the at least one additional first jaw adapter, at least one additional second jaw adapter, and at least one additional arbor together form at least one additional adapter set configured to operate on at least one additional fluid line having a diameter different than the first diameter.

15. The system of claim 10, wherein the arbor further includes:

a gripping portion that extends axially from the die head, that has a diameter larger than a diameter of the port so as to act as a stop surface for inserting the arbor into the port, and that is configured to be gripped by a further gripping tool.

16. The system of claim 15, wherein the arbor further includes:

a further die head that extends axially away from the gripping portion opposite the die head, the further die head configured to be inserted into a fluid line received in the channel as the arbor is inserted into the port to thereby form a further flared end in the fluid line, the further flared end being different than flared head formable via the die head.

17. The system of claim 10, wherein the channel includes a flare shape portion on each end, and the linear portion extends therebetween.

* * * * *